US009884219B2

(12) United States Patent
Bertolutti

(10) Patent No.: US 9,884,219 B2
(45) Date of Patent: Feb. 6, 2018

(54) EXERCISE APPARATUS

(71) Applicant: Roman Bertolutti, Kelowna (CA)

(72) Inventor: Roman Bertolutti, Kelowna (CA)

( * ) Notice: Subject to any disclaimer, the term of this patent is extended or adjusted under 35 U.S.C. 154(b) by 0 days.

(21) Appl. No.: 15/290,274

(22) Filed: Oct. 11, 2016

(65) Prior Publication Data

US 2017/0182348 A1 Jun. 29, 2017

Related U.S. Application Data

(63) Continuation-in-part of application No. 14/983,360, filed on Dec. 29, 2015.

(51) Int. Cl.

| | |
|---|---|
| ***A63B 23/12*** | (2006.01) |
| ***A63B 21/04*** | (2006.01) |
| ***A63B 21/00*** | (2006.01) |
| ***A63B 21/055*** | (2006.01) |

(52) U.S. Cl.

CPC ..... *A63B 21/0442* (2013.01); *A63B 21/0557* (2013.01); *A63B 21/4035* (2015.10); *A63B 23/12* (2013.01)

(58) Field of Classification Search

CPC ..... A63B 21/0552; A63B 21/0555; A63B 21/0557; A63B 21/4035

See application file for complete search history.

(56) References Cited

U.S. PATENT DOCUMENTS

| | | | | |
|---|---|---|---|---|
| 3,119,614 | A | 1/1964 | Berry | |
| 3,256,015 | A | 6/1966 | Perrin | |
| 4,195,835 | A | 4/1980 | Hinds et al. | |
| 4,328,964 | A | 5/1982 | Walls | |
| 4,779,867 | A | 10/1988 | Hinds | |
| 4,949,956 | A | 8/1990 | Pobran | |
| 5,556,368 | A | 9/1996 | Akin | |
| 5,885,190 | A | 3/1999 | Reiter | |
| 5,885,196 | A | 3/1999 | Gvoich | |
| 6,120,424 | A | 9/2000 | Arline | |
| 6,652,419 | B1 | 11/2003 | Rota | |
| 6,676,576 | B1 | 1/2004 | Wu | |
| 7,326,157 | B2 | 2/2008 | Wu | |
| 8,348,814 | B1 | 1/2013 | Hinds et al. | |
| 9,079,062 | B2 * | 7/2015 | Thomas | A63B 21/0442 |
| 2014/0073496 | A1 | 3/2014 | Bannerman | |

* cited by examiner

*Primary Examiner* — Loan H Thanh
*Assistant Examiner* — Rae Fischer
(74) *Attorney, Agent, or Firm* — Richard D. Okimaw

(57) ABSTRACT

An exercise apparatus comprises an elongate support member extending along a length between first and second ends. The rigid member has a passage extending therethrough between the first and second ends. The apparatus further comprises a handle extending between first and second handle ends, the handle having connectors proximate to each of the first and second ends and a grip section therebetween and at least one elongate flexible member extending through the passage of the support member and having end connectors on each end thereof, the at least end connectors being connectable to one of the connectors of the handle.

20 Claims, 14 Drawing Sheets

EXERCISE APPARATUS

CROSS REFERENCE TO RELATED APPLICATION

This application is a continuation in part application of U.S. patent application Ser. No. 14/983,360 filed Dec. 29, 2015 entitled Exercise Apparatus.

BACKGROUND OF THE INVENTION

1. Field of Invention

The present invention relates generally to exercise and in particular to a method and apparatus for permitting a user to exercise without interfering with their range of motion.

2. Description of Related Art

Many forms of exercise require a user to grasp and manipulate a handle against a resistance. One common way to do this is to suspend the handle from a cable or the like. One disadvantage that exists with common exercise equipment is that the centers of the handles are frequently aligned with the cable such that the cable may interfere with and overlap the path of at least part of the user's body. Accordingly, it will be appreciated that a user will therefore be limited in the movements that they are able to perform with such equipment.

Attempts have been made to provide a handle with connections at each end. However, such devices may commonly rely upon connecting the handle to two cables each having their own weight stack. It has been found that such devices may be unstable due to the differences in motion between the two weight stacks.

Additionally, other attempts have been made to replace the cables and weights with elastics. Such elastics commonly extend from a common source such as a connection point or bar to the handle. However, as elastics rely upon their length to stretch to provide the required resistance, it has been found that relatively long elastics have been required. Therefore, the handle is often required to be spaced away from the connection point or bar by a relatively long distance, which makes such devices cumbersome.

SUMMARY OF THE INVENTION

According to a first embodiment of the present invention there is disclosed an exercise apparatus comprising an elongate support member extending along a length between first and second ends, the elongate support member having a passage extending therethrough between the first and second ends, at least one elongate flexible member extending through the passage of the support member and having end connectors on each end thereof, and at least one handle extending having a grip portion thereon securable to the end connectors of the elongate flexible members.

The at least one handle may comprise a rigid handle extending between first and second handle ends, the handle having connectors proximate to each of the first and second ends and a grip section therebetween wherein the grip section extends along an axis angularly offset from a common axis between the first and second ends. The grip section may extend perpendicular to the common axis.

The at least one handle may comprise a pair of handles each secured to opposite ends of the at least one elongate flexible member. The pair of handles each may include a flexible tensile member extending therefrom wherein a free distal end of each of the flexible tensile members is connected to the end of the elongate flexible member. The pair of handles may extend between first and second ends with a pad proximate to a first end thereof, a grip portion proximate to a second end thereof and the flexible tensile member extending from a position therebetween.

The first and second ends of the support member may include rollers proximate to the first and second ends of the passage.

The support member may be adapted to be suspended from a mounting location. The exercise apparatus may further comprise a mounting assembly extending from the elongate support member to a common connection point. The mounting assembly may comprise straps extending between the common connection point to locations proximate to each of the first and second ends of the elongate support member. The elongate support member may include support bores extending therethrough adapted to pass the straps. The support bores may comprise a pair of bores each located proximate to side edges of the elongate support member. The support bores may be spaced apart from the side edges of the elongate support member by a distance selected to receive at least one elongate flexible member therethrough.

The flexible members may be elastic. The exercise apparatus may further comprise a plurality of flexible members.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
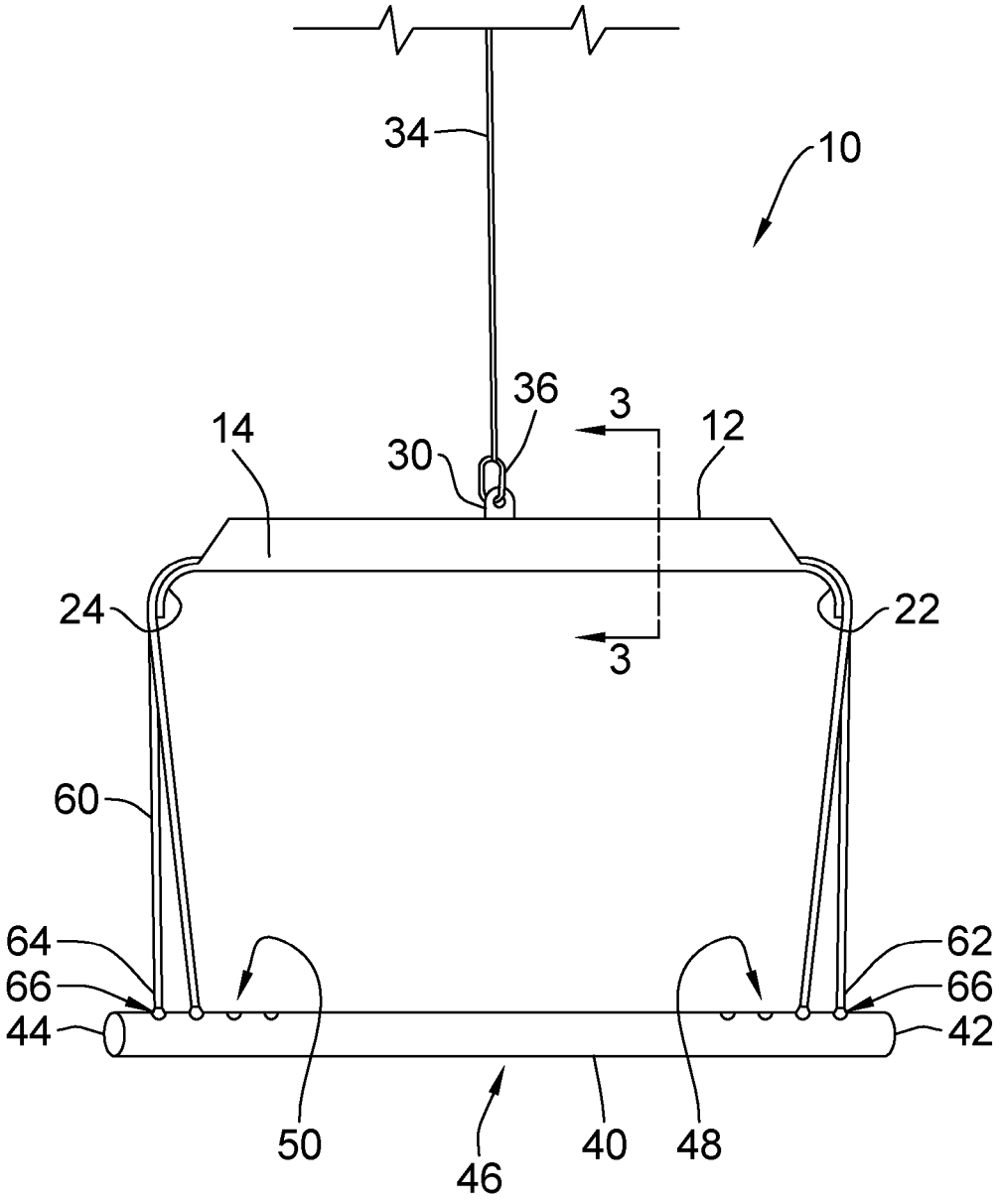
FIG. 1 is a perspective view of an exercise apparatus according to a first embodiment of the present invention.

Referring to FIG. 1, an exercise apparatus according to a first embodiment of the invention is shown generally at 10. The apparatus 10 comprises a top support 12, a handle 40 spaced there below and at least one flexible member 60 extending therebetween. In operation the user secures the top support 12 to a surface or body and grasps the handle 40 between the flexible members such that their range of motion of their arm is not impeded by the flexible members as will be more fully described below.

Figure 2:
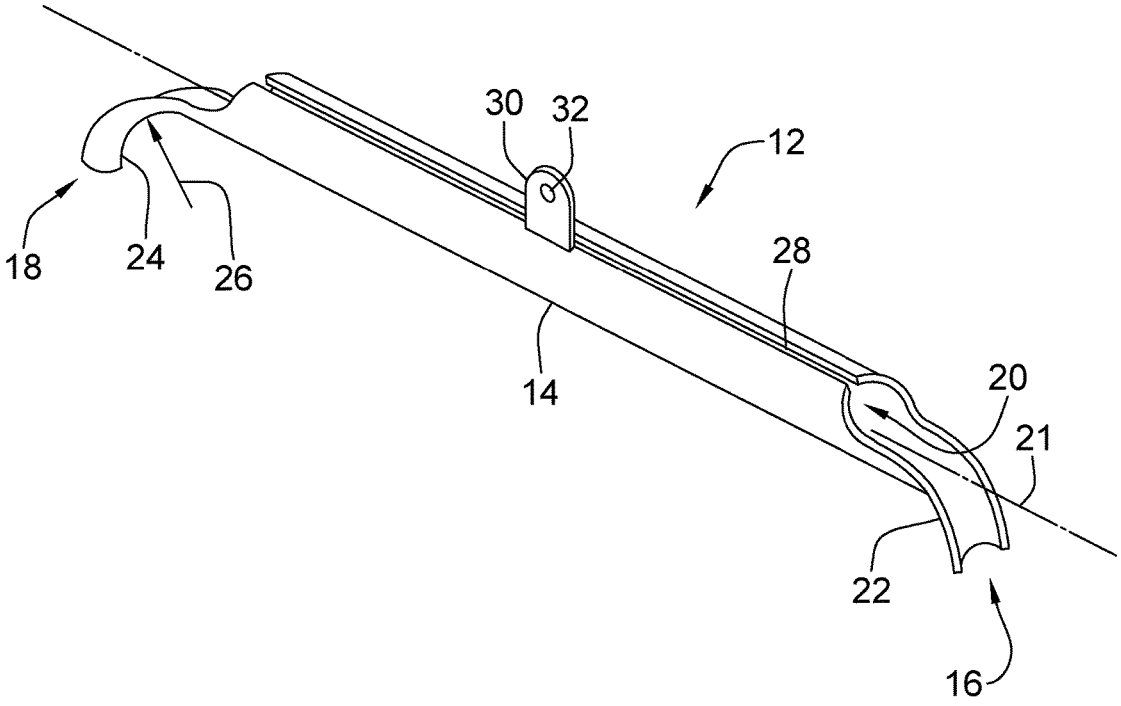
FIG. 2 is a perspective view of the top support of the exercise apparatus of FIG. 1.

Turning now to FIG. 2, the top support 12 comprises an elongate tubular body 14 extending between first and second ends, 16 and 18, respectively. The tubular body 14 defines a passage 20 therethrough having a slot 28 extending therealong so as to permit the flexible members 60 to be passed into the passage 20. As illustrated in FIGS. 1 and 2, the first and second ends 16 and 18 may include arcuate portions, 22 and 24, respectively curving away from a central axis 21 of the passage 20. The arcuate portions 22 and 24 have a radius of curvature 26 selected to reduce stress and provide free motion of the flexible members 60 thereover as will be more fully described below. In practice it has been found that a radius of between ½ and 8 inches (13 and 203 mm) has been useful although it will be appreciated that other dimensions may be useful as well.

The top support 12 includes a mounting location 30 adapted to permit the top support 12 to be suspended from an object. As illustrated in FIGS. 1 and 2, the mounting location 30 may comprise a tab extending from the tubular body proximate to the slot 28. The tab may include a bore 32 therethrough operable to receive a clip 36 such as a carabiner or the like. As illustrated in FIG. 1, the clip 36 may be secured to the end of a cable 34 such that the cable suspends the top support 12 at the location desired by a user. The mounting location 30 is located at the middle of the tubular body 14 such that the top support 12 will be balanced when supported by the mounting location.

Figure 6:
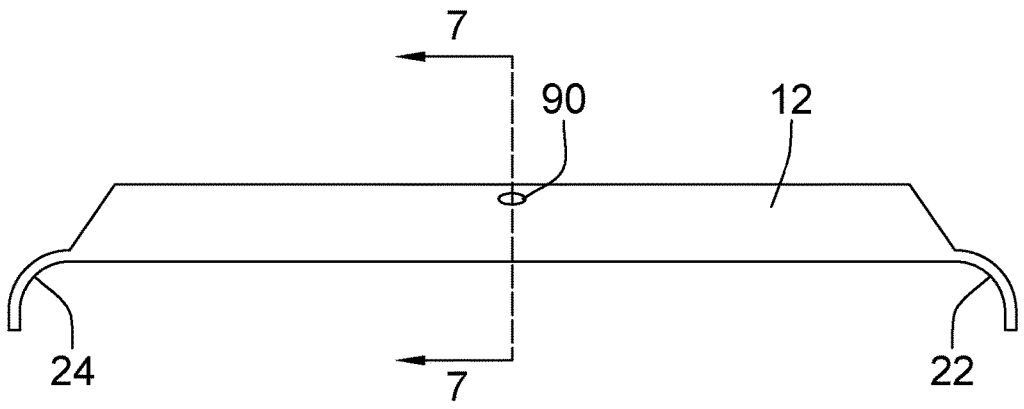
FIG. 6 is a perspective view of a top support of the exercise apparatus according to a further embodiment.
Figure 7:
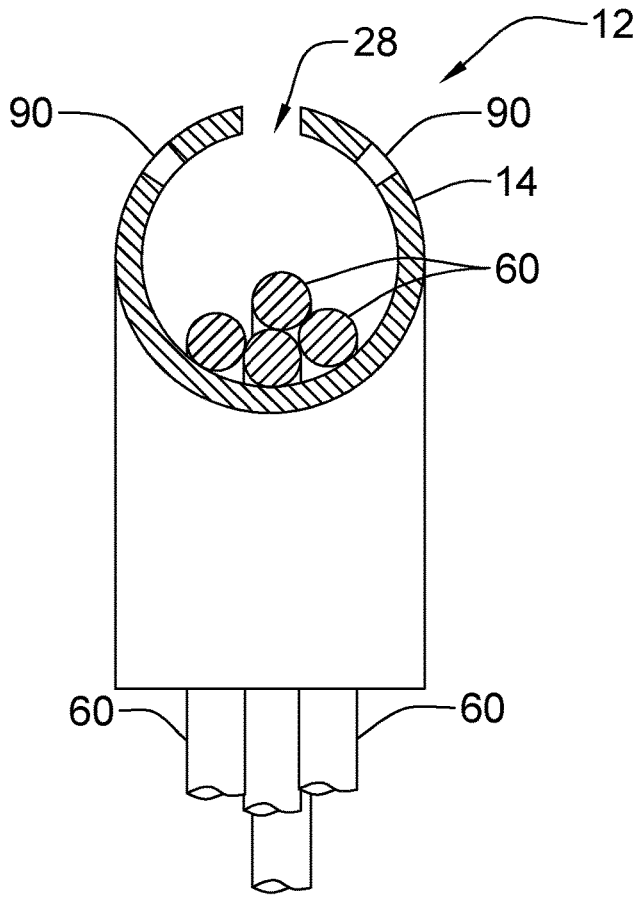
FIG. 7 is a cross sectional view of the top support of the exercise apparatus of FIG. 6 as taken along the line 7-7.

Optionally, as illustrated in FIGS. 6 and 7, the mounting location may comprise one or more bores 90 passing through the top support 12 to either side of the slot 28 so as to be operable to receive a clip, hook or the like therein. In operation, the clip or hook may be passed through one or both of the bores 90.

Figure 3:
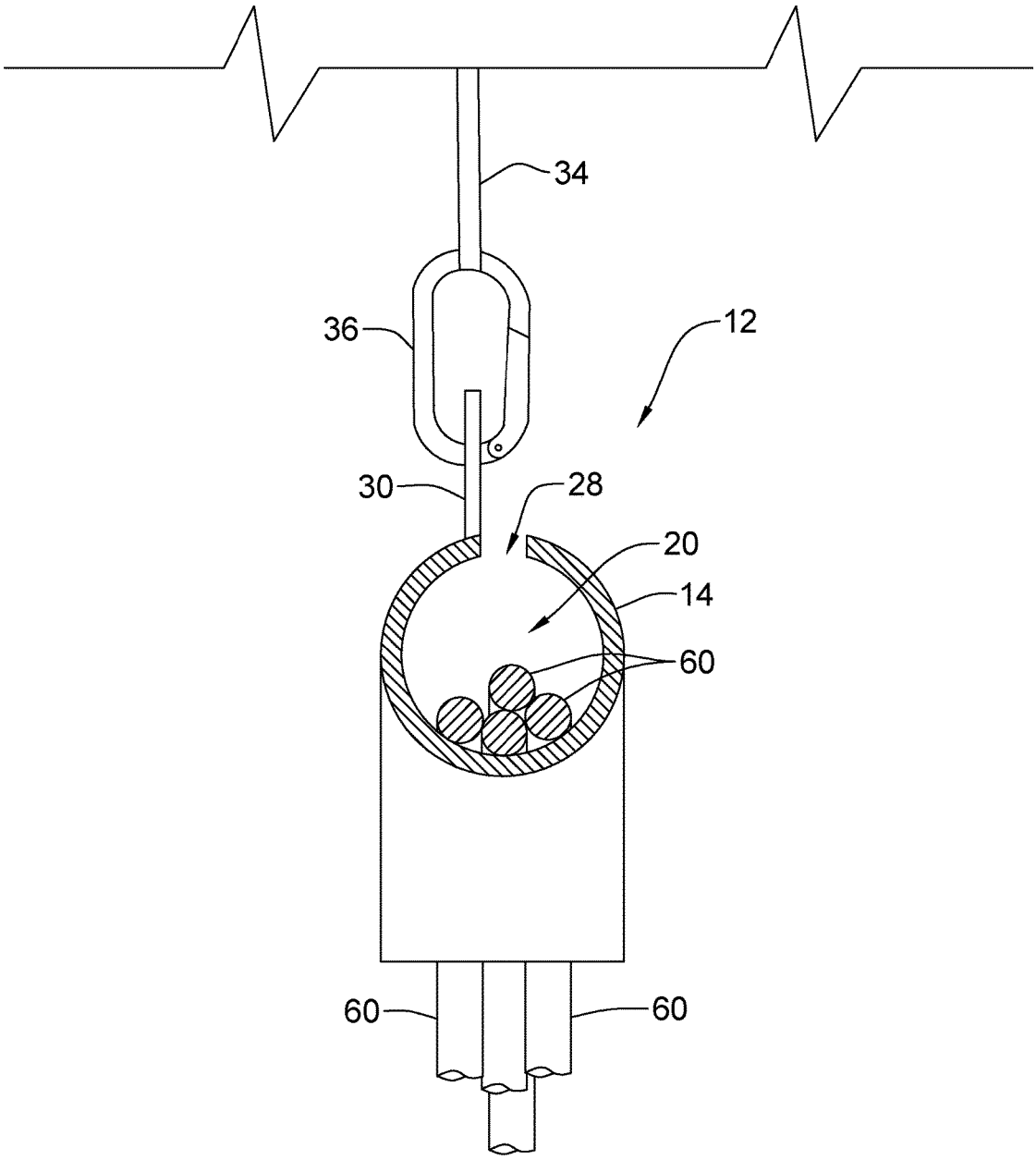
FIG. 3 is a cross sectional view of the top support of the exercise apparatus of FIG. 1 as taken along the line 3-3.

Turning now to FIG. 3, a cross sectional view of the top support 12 is illustrated. As illustrated, the tubular body 14 of the top support may have a substantially circular cross section however it will be appreciated that other cross section profiles may also be useful such as, by way of non-limiting example, oval, square, rectangular, triangular or irregular. As illustrated, one or more flexible members 60 may extend through the passage 20 to connect to each end of the handle, as will be more fully described below.

Figure 11:
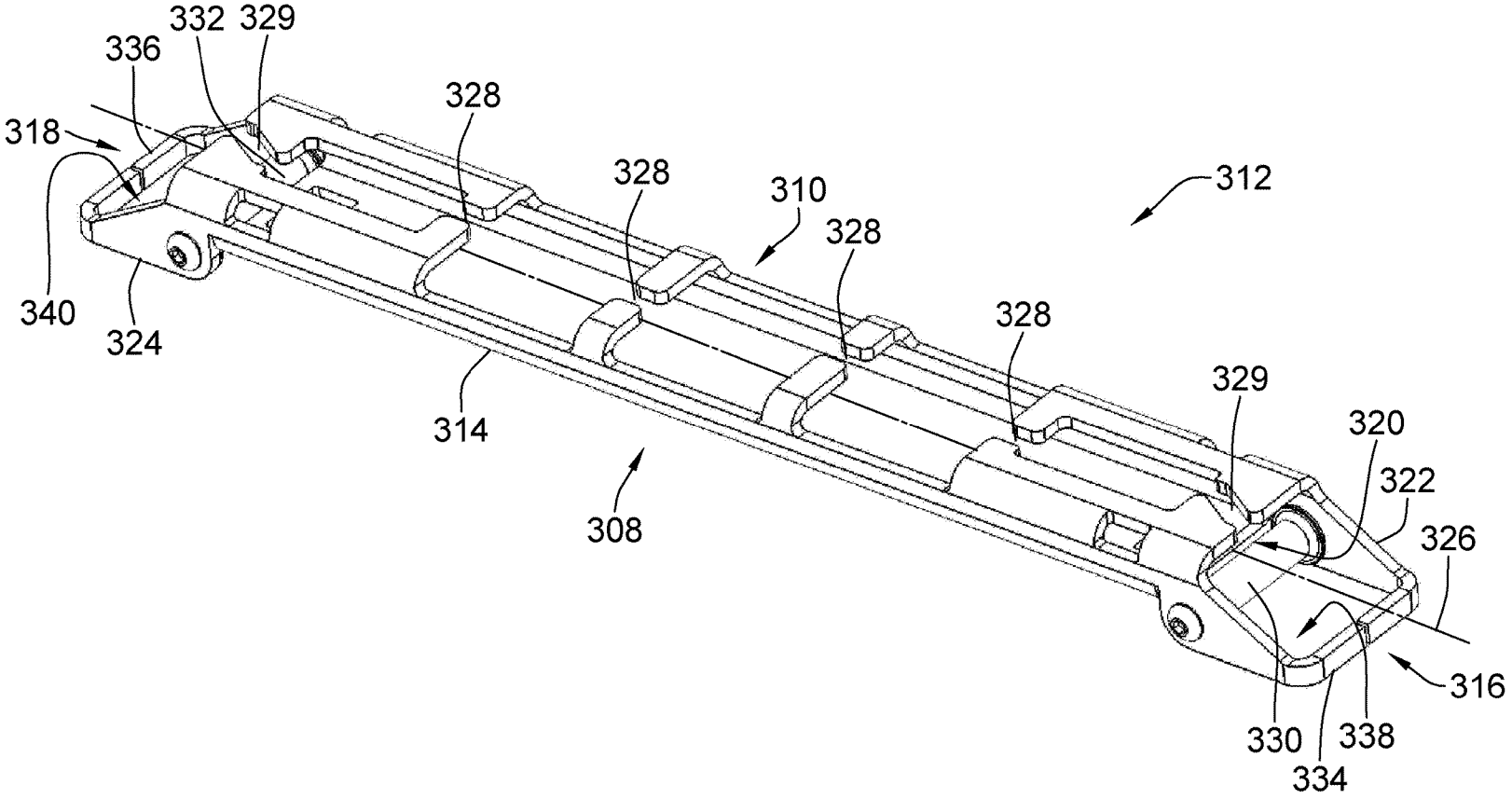
FIG. 11 is a perspective view of the top support according to a further embodiment.
Figure 14:
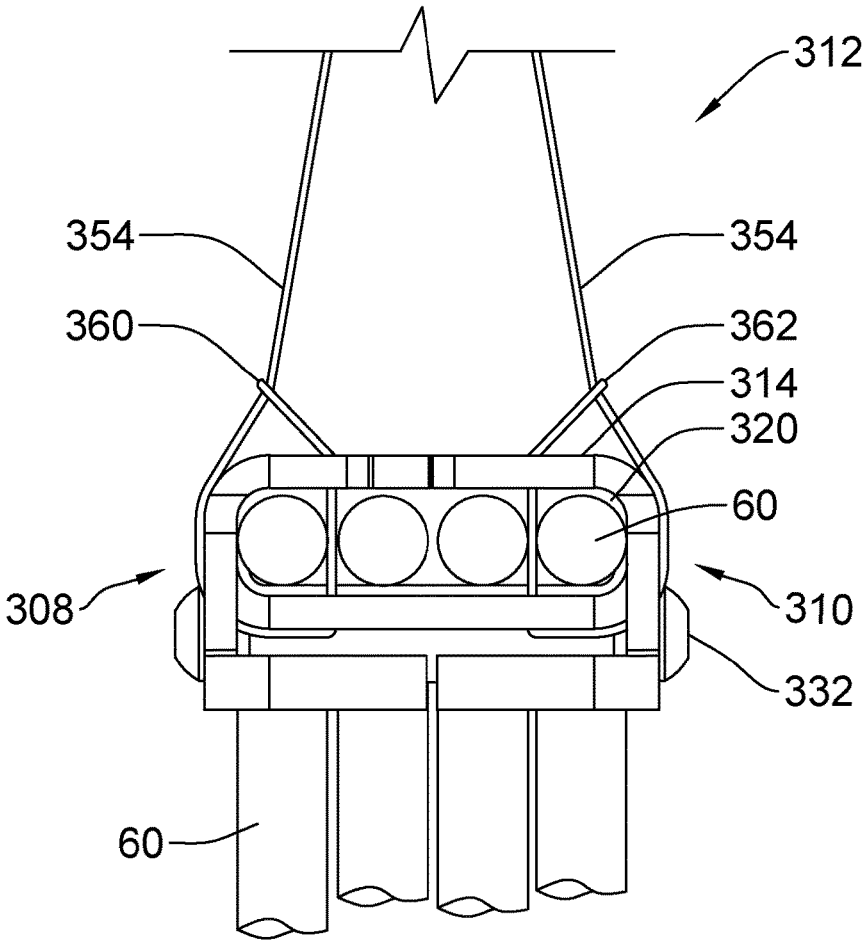
FIG. 14 is a cross sectional view of the top support of FIG. 11, as taken along the line 14-14 of FIG. 12.

Although one style of top support 12 is illustrated and set out above, it will be appreciated that other styles of support may be utilized, as well. Turning now to FIG. 11, a further embodiment of the top support is generally illustrated at 312. The top support 312 comprises an elongate rounded rectangular tubular body 314 extending between first and second ends, 316 and 318, respectively, and between first and second sides, 308 and 310, respectively. The distance between the first and second ends, 316 and 318, may be such as, by way of non-limiting example, between 10 and 24 inches (254 and 610 mm), although it will be appreciated that other lengths may be useful, as well. The distance between the first and second sides, 308 and 310, may be such as, by way of non-limiting example, between 2 and 6 inches (50 and 152 mm), although it will be appreciated that other lengths may be useful, as well. The tubular body 314 defines a passage 320 therethrough, having a plurality of offset slots 328 extending therealong so as to permit the flexible members 60 to be passed into the passage 320. The slots 328 may be offset, as illustrated, so as to retain the flexible members 60 therein. Additionally, a plurality of angled slots 329 may be included proximate to the first and second ends, 316 and 318, so as to retain the flexible members 60 within the passage 320, requiring manipulation thereof to insert or remove the flexible members 60. The passage 320 is adapted to retain the flexible members 60 in parallel alignment with minimal interference therebetween, as illustrated in FIG. 14. Although FIG. 14 illustrates four flexible members 60 therein, it will be appreciated that the tubular body 314 may be sized to receive more or less flexible members 60 therein. As illustrated in FIG. 1, the top surface of the tubular body 314 may be substantially flat so as to permit the tubular body 314 to be rested on a ground surface with the flexible members 60 extending upwardly therefrom for use in performing squats or the like as will be more fully described below.

Figure 13:
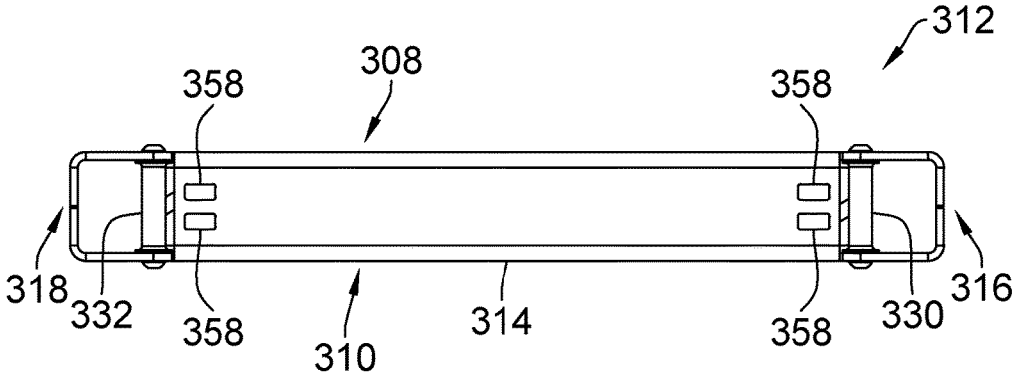
FIG. 13 is a bottom view of the top support of FIG. 11.

Returning to FIG. 11, proximate to the first and second ends 316 and 318, first and second end portions, 322 and 324, respectively, may include rollers, 330 and 332, respectively, as are commonly known, aligned perpendicularly to a central axis 326 of the passage 320, with each roller 330 and 332 positioned such that the flexible members 60 may pass thereover. The rollers 330 and 332 are selected to reduce stress and provide free motion of the flexible members 60 thereover. It has been found that rollers with a radius of between ½ and 5 inches (13 to 127 mm) have been useful, although it will be appreciated that other dimensions may be useful as well. Each of the first and second end portions, 322 and 324, may include a retaining portion, 334 and 336, respectively, at the ends thereof, forming first and second gaps, 338 and 340, respectively, between each roller, 330 and 332, and respective retaining portion, 334 and 336, which the flexible members 60 may pass therethrough. Referring to FIG. 13, the base of the tubular body 314 includes a plurality of rectangular bores 358 proximate to the first and second ends 316 and 318, the purpose of which will be described in more detail below.

Figure 12:
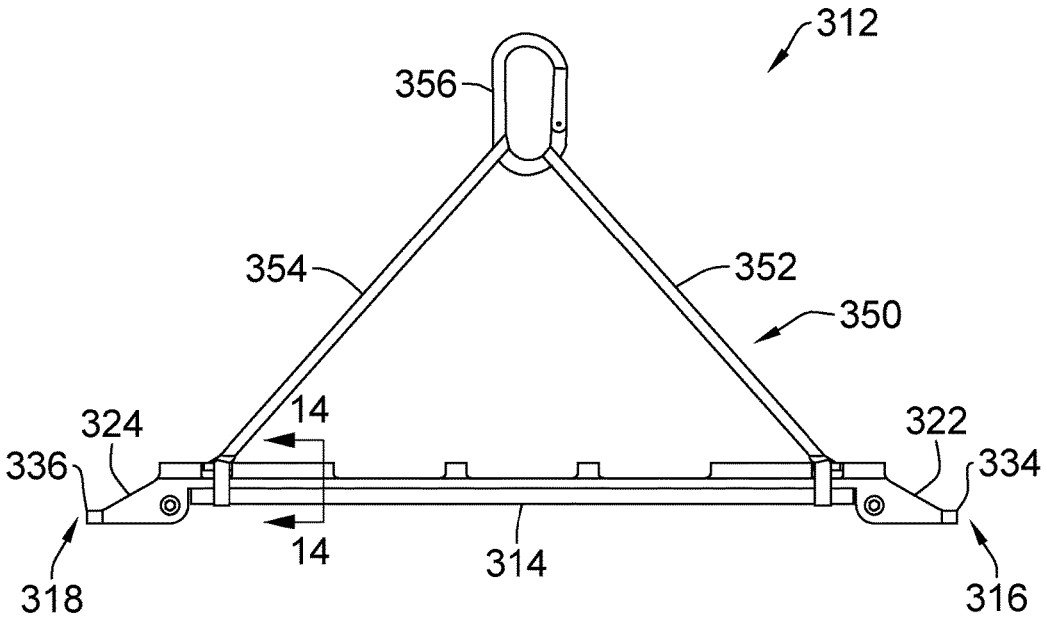
FIG. 12 is a side view of the top support of FIG. 11.

The top support 312 includes a mounting assembly 350 adapted to permit the top support 312 to be suspended from an object. As illustrated in FIGS. 12 and 14, the mounting assembly 350 may include first and second mounting straps, 352 and 354, respectively, connected to a clip 356 such as a carabiner or the like. The mounting straps 352 and 354 may be constructed using such as, by way of non-limiting example, polyester webbing, or any other suitable materials. The mounting straps 352 and 354 are sized such that the clip 356 suspends the top support 312 over the middle of the tubular body 314 such that the top support 312 will be balanced when supported by the mounting location. Referring to FIG. 14, and using the second end 318 by example, the second mounting strap 354 includes first and second end loops, 360 and 362, formed therein by any known means, such as, by way of non-limiting example, sewed with thread. Similarly, the first mounting strap 352 includes first and second end loops (not shown). Referring to FIGS. 11, 13 and 14 the second mounting strap 354 passes through a notch 328 or opening in the tubular body 314 proximate to the second end 318, through the passage 320 between two flexible members 60 proximate to the first side 308, as illustrated in FIG. 14, and through a rectangular bore 358 in the base of the tubular body 314, as illustrated in FIG. 13, then around the first side 308 of the tubular body 314 and through the first end loop 360, as illustrated in FIG. 14, then up through the clip 356, as illustrated in FIG. 12, and back down through the tubular body 314 in a similar manner on the second side 310, with the second mounting strap 354 passing through the second end loop 362 to secure it thereto the tubular body 314. The first mounting strap 352 passes through the tubular body 312 in a similar manner proximate to the first end 316. In such a manner, the first and second straps 352 and 354 form end loops through the sides of the tubular body 314 proximate to each side 308 and 310 thereof. As illustrated in FIG. 14, the loops thus formed may separate one or more of the flexible members 60 from the others so as to assist in organizing the flexible members therein. It will be appreciated that such side by side organization of the flexible members will assist to prevent binding and jamming of the flexible members therein.

With reference to FIG. 1, the handle 40 comprises an elongate rigid member extending between first and second ends, 42 and 44 respectively with a grip portion 46 therebetween. Proximate to each of the first and second ends 42 and 44 are connectors, 48 and 50, the details of which will be further described below for connection to the flexible members 60.

Figure 4:
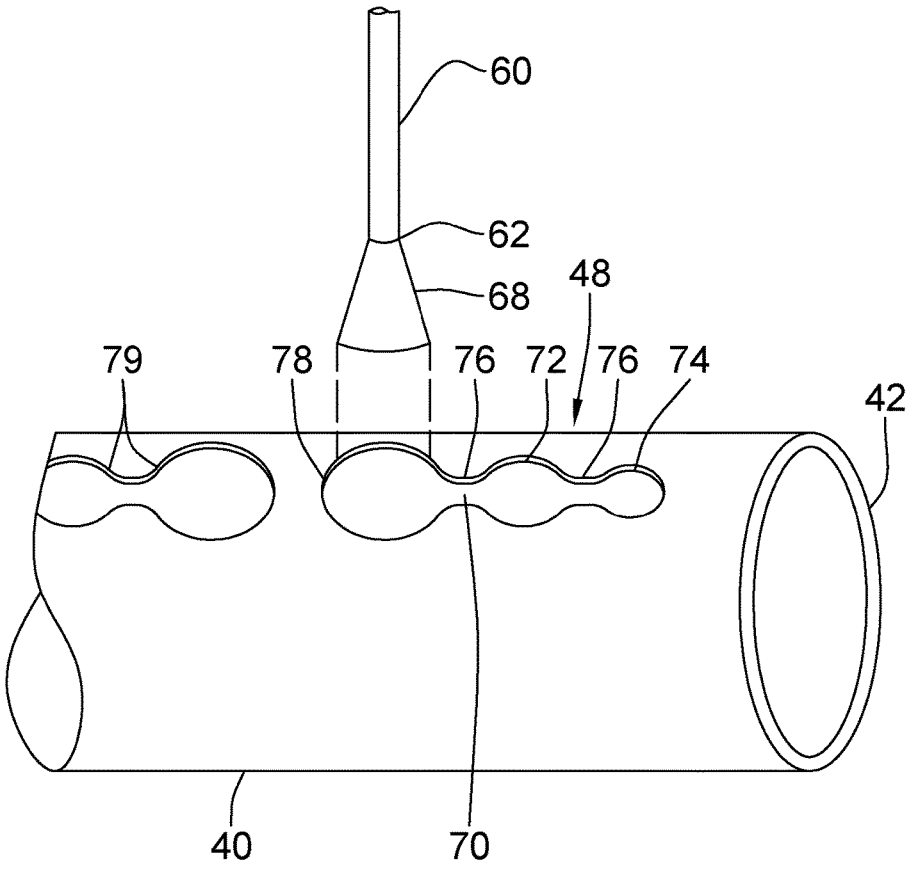
FIG. 4 is a detailed exploded view of the connectors between the elastic members and the handle of the exercise apparatus of FIG. 1.

The flexible member 60 extends between first and second ends, 62 and 64, respectively. Each of the first and second ends 62 and 64 includes an end connector 66 for connection to the connectors 48 and 50 of the handle. As illustrated in FIG. 1, the flexible member 60 is passed through a slot 70 of the handle 40, as will be described in more detail below, such that the end connector 66 at the first end 62 is connected to the connector 48 of the first end 42 of the handle. Similarly, the end connector 66 at the second end 64 is connected to the connector 50 of the second end 44 of the handle. In such a manner the flexible member 60 suspends the handle 40 below the top support 12. As illustrated in FIG. 4, the connector may comprise a flared end 68 sized to have a non-deformable thickness greater than the thickness of the flexible member as are commonly known.

The flexible member 60 may be elastic, such as by way of non-limiting example, formed of rubber, silicon or the like as are commonly known. The flexible member 60 may be selected to have a thickness and resilience to provide a desired biasing force under stretch for the exercise to be provided. The flexible member 60 is permitted to stretch along its entire length during exercise such that the portion within the passage 20 as well as the portions between the top support 12 and the handle 40 are permitted to stretch to provide the desired resistance. In such manner, a more consistent biasing force is provided and a reduced distance may be provided between the handle and the top support. As illustrated in FIG. 1, a plurality of flexible members 60 may be provided to enable a user to adjust the resistance provided upon the handle for each exercise. Additionally, each of the resilient members may be provided with a different modulus of elasticity so as to provide a different level of resistance for a user so as to enable the user to customize, through selecting different combinations of the elastic members, the level of total resistance provided. It will be appreciated that each different level of resistance may be coloured a different colour to assist the user in differentiate between the different levels of resistance. Optionally, the flexible member may be selected to be non elastic such that the average distance between the top support 12 and the handle 40 remains constant while permitting the handle to rotate relative to the top support through sliding the flexible members through the passage 20. Such arrangement will be useful for suspending the top support 12 from a cable connected to a weight stack for use in exercise.

Turning now to FIG. 4, one embodiment of the connection between the flexible members 60 and the handle 40 is illustrated. As set out above the ends of the flexible member 60 include flared non-deformable bodies having a width greater than the width of the flexible member. The handle 40 may be substantially hollow wherein the first connector 48 of the handle comprises a slot 70 extending into the handle 40. The slot 70 includes one or more receiving locations 72 and 74 comprising a bore sized to have a diameter between the flexible member and the diameter of the flared end 68. In such a manner, the flexible ember may pass through the receiving location 72 or 74 while the flared end 68 is retained therein. The slot 70 also includes an entrance 78 sized larger than the flared end 68 such that the flared end 68 may be freely passed therethrough into the interior of the handle. The receiving locations 72 and 74 and entrance 78 may include narrowed portions 76 therebetween to differentiate between such locations and retain the flared end 68 within the receiving locations as desired. As illustrated, the receiving locations and narrowed portions may include a rounded transition 79 therebetween. In operation, a user may pass the flared end 68 through the entrance 78 and thereafter slide the flexible member to the desired receiving location. Thereafter pulling the flexible member 60 away from the handle will set the flared end 68 within the desired receiving location providing a secure fit between.

Figure 5:
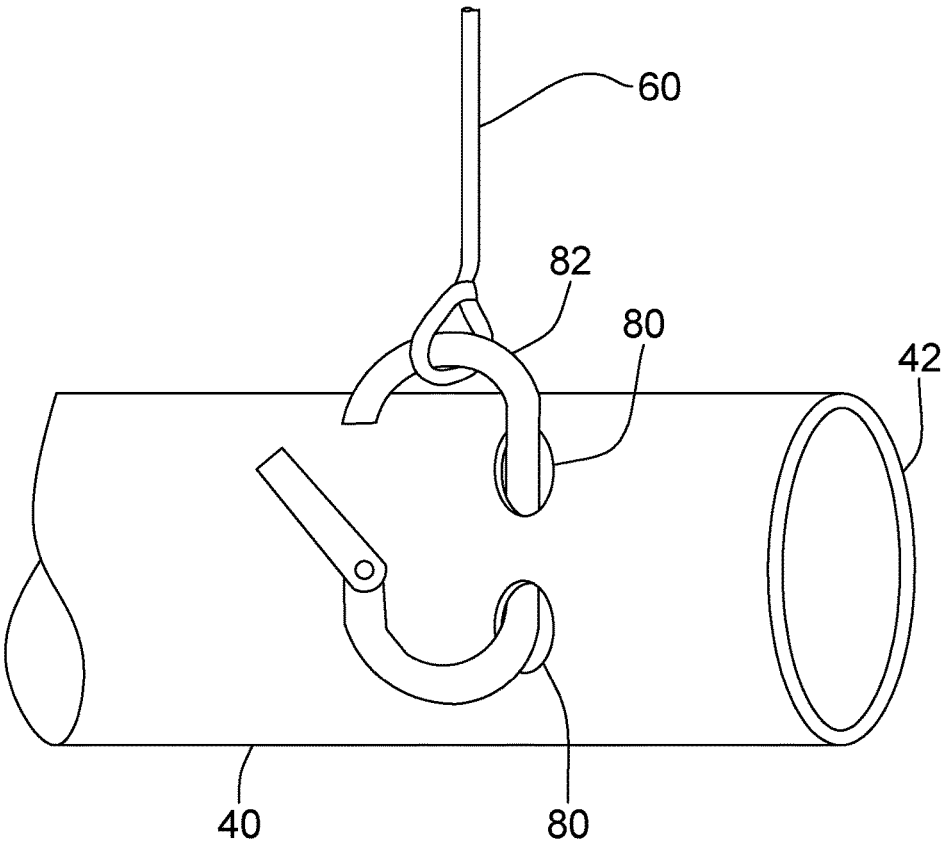
FIG. 5 is a detailed exploded view of the connectors between the elastic members and the handle of the exercise apparatus of FIG. 1 according to a further embodiment.

Although one style of connection between the flexible member 60 and handle 40 is illustrated and set out above, it will be appreciated that other styles of connections may also be utilized, such as by way of non-limiting example, hooks, carabineers 82 as illustrated in FIG. 5 or the like. In particular, as illustrated in FIG. 5, the handle 40 may include a pair of bores 80 extending transversely through the handle so as to permit a carabiner 82 or the like to be passed therethrough. The carabiner 82 may then in turn be connected to a flexible member 60 through any known means. As illustrated in FIG. 5, the bores 80 may be aligned so as to form a path through the handle 40 offset from the center thereof. As illustrated in FIG. 4, the connector 48 is provided with two receiving locations 72 and 74. To reduce the deforming of the slot 70 due to long lengths of such structures, if additional receiving locations are desired, more than one slot may be provided as illustrated in FIG. 4.

Figure 10:
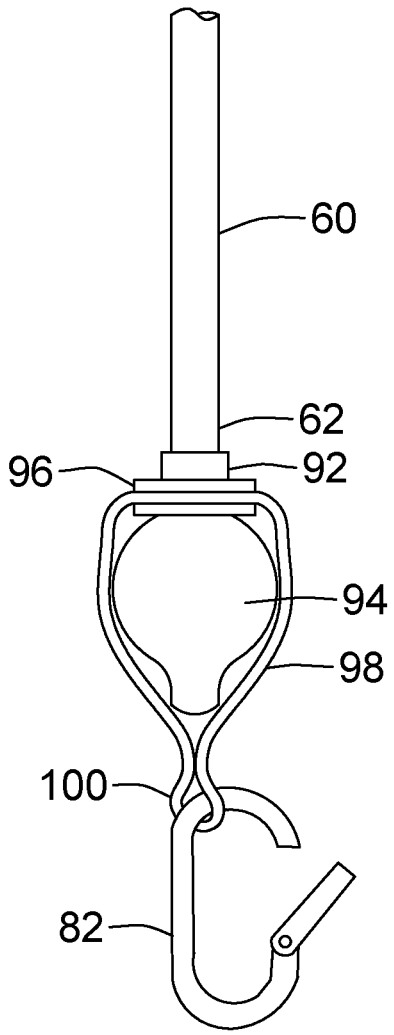
FIG. 10 is a detailed side view of the connectors at the distal end of the elastic members according to a further embodiment.

FIG. 10 illustrates a further embodiment of a connection end style which may be used to connect the flexible member 60 and handle 40. In particular, each of the first and second ends 62 and 64 may include a flexible end connector sleeve 92 which is stretched over a portion of the flexible member 60 and contains therein an enlarged stopper 94, which may be spherical, as illustrated, although other shapes may be useful as well. The enlarged stopper 94 may be secured within the flexible member 60 as well or optionally only within the connector sleeve 92. The flexible member 60 passes through an eyelet 96, as is commonly known, in a strap 98, with the enlarged stopper 94 retaining the eyelet 96 and strap 98 thereon. The strap 98 may be constructed using such as by way of non-limiting example, polyester webbing, or any other suitable material, and is formed by any known means, such as sewn with thread, to encircle the enlarged stopper 94 and includes a loop 100 at the distal end thereof sized so as to permit a carabiner 82 or the like to be passed therethrough. The carabiner 82 may then in turn be connected to the handle 40 as outlined above.

Figure 8:
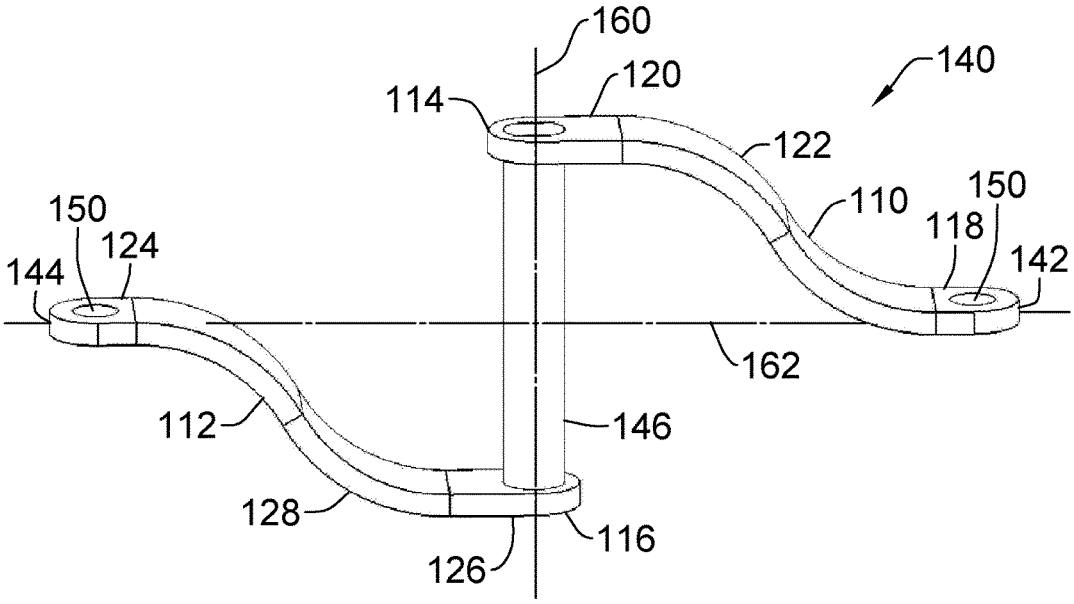
FIG. 8 is a perspective view of a handle according to a further embodiment.
Figure 9:
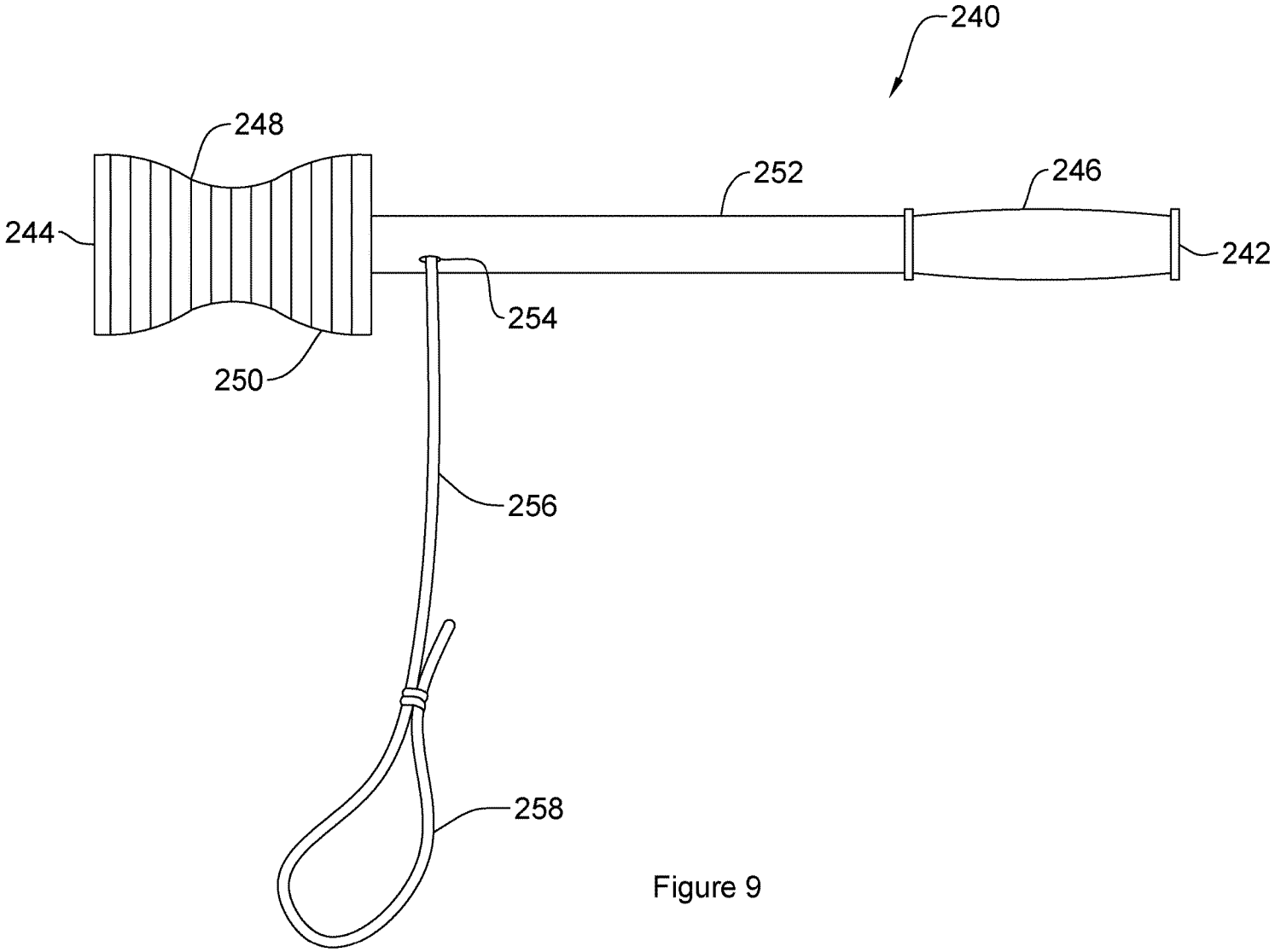
FIG. 9 is a side view of a handle according to a further embodiment.
Figure 15:
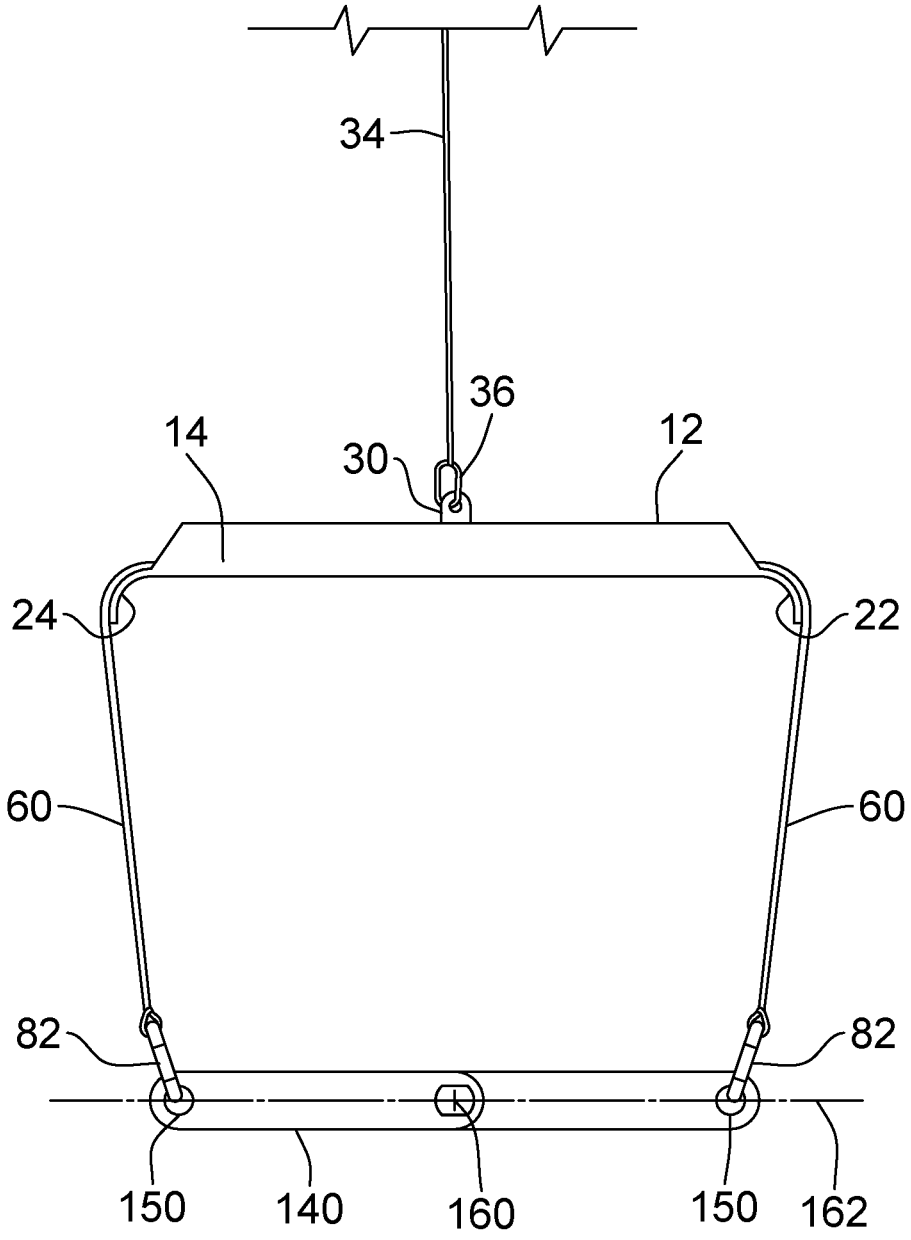
FIG. 15 is side view of the handle of FIG. 8 attached to the exercise apparatus of FIG. 1.

Although one style of handle is illustrated and set out above, it will be appreciated that other styles of handles may also be utilized, as well, such as the handles illustrated in FIGS. 8 and 9. Referring to FIGS. 8 and 15, a further embodiment of a handle is illustrated generally at 140. The handle 140 comprises first and second end portions, 110 and 112, respectively, with a grip portion 146 extending along a grip axis 160 at the midpoint therebetween. The elongate rigid grip portion 146 extends between front and rear edges, 114 and 116, respectively, with the first and second end portions, 110 and 112, extending transversely therefrom each edge, 114 and 116. The first end portion 110, extending between a first end 142 and the front edge 114 of the grip portion 146, comprises a straight end portion 118 proximate to the first end 142, a straight end portion 120 proximate to the front edge 114, and an s-curve portion 122 therebetween. The second end portion 112, extending between a second end 144 and the rear edge 116 of the grip portion 146, comprises a straight end portion 124 proximate to the second end 144, a straight end portion 126 proximate to the rear edge 116, and an s-curve portion 128 therebetween. The s-curve portions 122 and 128 are sized and curved such that the straight end portions 118 and 124 extend along a common axis 162, angularly to the axis 160, through the center of the grip portion 146. It will be appreciated that the common axis may extend perpendicular to the grip axis or any other angular orientation to facilitate the desired grip position by a user. Each straight end portion 118 and 124 includes a bore 150 extending transversely therethrough, sized to so as to permit a carabiner 82 or the like to be passed therethrough, as set out above. The carabiner 82 may then in turn be connected to a flexible member 60 through any known means.

Turning now to FIG. 9, a further embodiment of the handle is illustrated generally at 240. In this embodiment, two of the handle 240 may be connected to the apparatus 10 simultaneously, one at each of the first and second ends, 62 and 64, of the flexible member 60. The handle 240 comprises an elongate rigid member 252 extending between first and second ends, 242 and 244, respectively, with an outer grip portion 246 thereon proximate to the first end 242 and an outer shoulder pad portion 248 thereon proximate to the second end 244. The outer grip portion 246 may be formed of any suitable material to be gripped by a user's hand, such as, by way of non-limiting example, a rigid plastic such as injection-molded nylon, composite rubber or foam. The outer shoulder pad portion 248 may be generally spool or hourglass shaped, thereby presenting a circumferentially concave support surface 250, with a minimum diameter greater than the diameter of the elongate rigid member 252. The concave support surface 250 is adapted to rest upon a user's shoulder. The outer shoulder pad portion 248 may be formed of any suitable padding material, such as, by way of non-limiting example, foam, rubber or any other padding material as is commonly known. Although the shoulder pad portion 248 is illustrated as an hourglass shape, it will be appreciated that other shapes, such as cylindrical, may be useful, as well. The elongate rigid member 252 includes a bore 254 therethrough proximate to the should pad portion 248 adapted to receive and retain a flexible tensile member 256 therein. The flexible tensile member 256 may be retained within the elongate rigid member 252 by any known means, such as, by way of non-limiting example, a knot, as is commonly known. As illustrated in FIG. 9, a loop 258 may be formed in the distal end of the flexible tensile member 256 so as to permit a carabiner 82 or the like to be passed therethrough, as set out above. The carabiner 82 may then in turn be connected to a flexible member 60 through any known means.

Figure 16:
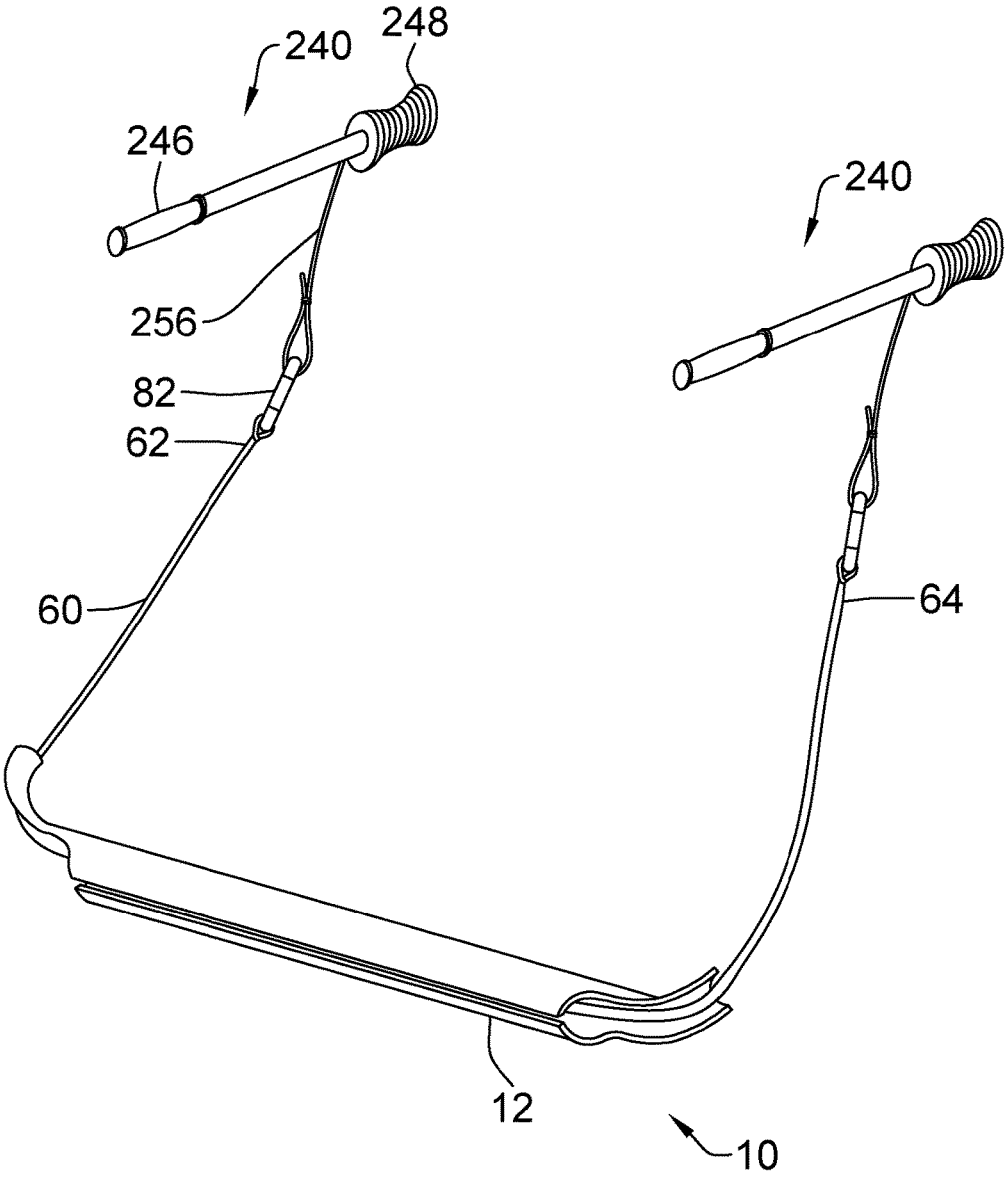
FIG. 16 is a perspective view of the handles of FIG. 9 attached to the exercise apparatus of FIG. 1.

Referring to FIG. 16, to utilize the apparatus 10 with the handle 240, a handle 240 is connected to a flexible member 60 as set out above. The top support 12 is placed on the floor and the user secures the top support 12 to the floor by placing one or both feet thereon. The user may be in a squatting position, as is commonly known, and places the outer shoulder pad portion 248 of the handle 240 on the user's shoulder, with the handle 240 extending transversely forward from the user's body. The user grasps the outer grip portion 246, with the flexible tensile member 256 extending down from the handle 240 to the flexible member 60. To add tension, the user may twist the handle 240 such that the flexible tensile member 256 is wrapped therearound, thereby decreasing the length between the handle 240 and the top support 12. The user raises from a squatting position to a standing position, while maintaining the handle 240 in position, thereby extending the flexible member 60. It will be appreciated that two handles 240 may be used simultaneously with the top support 12 secured beneath the user's feet with one handle 240 connected to the first end 62 of the flexible member 60, while a second handle 240 is connected to the second end 64 of the flexible member 60.

While specific embodiments of the invention have been described and illustrated, such embodiments should be considered illustrative of the invention only and not as limiting the invention as construed in accordance with the accompanying claims.

What is claimed is:

1. An exercise apparatus comprising:

an elongate rigid support member extending between first and second elongate rigid support member ends and having a passage extending between the first and second elongate rigid support member ends;

an elongate flexible member extending through the passage of the elongate rigid support member, wherein the elongate flexible member comprises two ends, each having an attached end connector; and a handle comprising:

two end portions; and a grip portion positioned between the two end portions, wherein the longitudinal axis of the grip portion is oriented angularly offset relative to the longitudinal axis of each end portion.

2. The exercise apparatus of claim 1, wherein the longitudinal axis of the grip portion is perpendicular to the longitudinal axis of each end portion.

3. The exercise apparatus of claim 1, further comprising a roller proximate to one end of the elongate rigid support member.

4. The exercise apparatus of claim 1, wherein the elongate rigid support member further includes a mount extending from a top portion of the elongate rigid support member for supporting the elongate rigid support member from an external object.

5. The exercise apparatus of claim 1, further comprising a mounting assembly extending from the elongate rigid support member.

6. The exercise apparatus of claim 5, wherein the mounting assembly comprises two straps, one attached to the elongate rigid support member proximate each of the first and second elongate rigid support member ends.

7. The exercise apparatus of claim 6, further comprising a bore passing through the elongate rigid support member and configured for insertion of one of the straps.

8. The exercise apparatus of claim 7, further comprising a second bore passing through the elongate rigid support member and configured for insertion of one of the straps.

9. The exercise apparatus of claim 1, wherein the elongate flexible member is elastic.

10. The exercise apparatus of claim 1, further comprising a second elongate flexible member.

11. An exercise apparatus comprising:

an elongate rigid support member extending between first and second elongate rigid support member ends and having a passage extending between the first and second elongate rigid support member ends;

an elongate flexible member extending through the passage of the elongate rigid support member, wherein the elongate flexible member comprises two ends, each having an attached end connector; and two handles, each configured for attachment to the elongate flexible member and each comprising:

two end portions;

a grip portion positioned between the two end portions; and a flexible tensile member extending from the handle and configured for connection to an elongate flexible member end.

12. The exercise apparatus of claim 11, wherein each handle comprises a pad proximate to the first end portion, wherein the grip portion is proximate to the second end portion, and wherein the flexible tensile member extends from a position between the first and second end portions.

13. The exercise apparatus of claim 11, further comprising a roller proximate to one end of the elongate rigid support member.

14. The exercise apparatus of claim 11, wherein the elongate rigid support member further includes a mount extending from a top portion of the elongate rigid support member for supporting the elongate rigid support member from an external object.

15. The exercise apparatus of claim 11, further comprising a mounting assembly extending from the elongate rigid support member.

16. The exercise apparatus of claim 15, wherein the mounting assembly comprises two straps, one attached to the elongate rigid support member proximate each of the first and second elongate rigid support member ends.

17. The exercise apparatus of claim 16, further comprising a bore passing through the elongate rigid support member and configured for insertion of one of the straps.

18. The exercise apparatus of claim 8, further comprising a second bore passing through the elongate rigid support member and configured for insertion of one of the straps.

19. The exercise apparatus of claim 11, wherein the elongate flexible member is elastic.

20. The exercise apparatus of claim 11, further comprising a second elongate flexible member.

* * * * *